US007478484B2

(12) United States Patent
Nepil et al.

(10) Patent No.: US 7,478,484 B2
(45) Date of Patent: Jan. 20, 2009

(54) CHALK LINE APPARATUS WITH A SPOOL CONFIGURED TO AVOID CAVITATION

(75) Inventors: Mark Nepil, St. Charles, IL (US); Clyde Torp, Naperville, IL (US)

(73) Assignee: Keson Industries, Aurora, IL (US)

( * ) Notice: Subject to any disclaimer, the term of this patent is extended or adjusted under 35 U.S.C. 154(b) by 32 days.

(21) Appl. No.: 11/810,860

(22) Filed: Jun. 7, 2007

(65) Prior Publication Data

US 2008/0301960 A1 Dec. 11, 2008

(51) Int. Cl.
*B44D 3/38* (2006.01)
*B65H 75/18* (2006.01)

(52) U.S. Cl. ..... 33/414; 242/407

(58) Field of Classification Search ..... 33/1 LE, 33/413, 414; 242/407
See application file for complete search history.

(56) References Cited

U.S. PATENT DOCUMENTS 384,444 A * 6/1888 Howard ..... 33/414
851,770 A * 4/1907 Nichols ..... 242/407
5,644,852 A 7/1997 Fuller et al.
5,683,055 A 11/1997 Dufour
5,727,324 A 3/1998 Moore
5,822,874 A * 10/1998 Nemes ..... 33/414
6,098,299 A 8/2000 Collins et al.
6,393,709 B1 5/2002 Jones
6,957,495 B1 10/2005 Schmillen
7,331,116 B1 * 2/2008 Johnston et al. ..... 33/414
2003/0221325 A1 12/2003 Dekort
2004/0168335 A1 9/2004 Pritchard
2005/0132590 A1 6/2005 Scillia et al.
2006/0021241 A1 2/2006 Bond
2006/0042108 A1 3/2006 Nepil

* cited by examiner

*Primary Examiner*—G. Bradley Bennett
(74) *Attorney, Agent, or Firm*—Wood Phillips Katz Clark & Mortimer

(57) ABSTRACT

A chalk line apparatus having a housing defining a chamber within which a supply of chalk can be stored and a reel within the chamber and mounted for rotation relative to the housing around a first axis. The housing has an opening through which a flexible line emanating from the reel can extend to outwardly of the housing for use. The reel has a spool defining a support against and around which a flexible line can be wrapped. The spool is rotatable around the first axis and has an axial extent. The spool is configured so that line wrapped around the support does not have a substantially cylindrical shape centered on the first axis over any substantial portion of the axial extent of the spool.

22 Claims, 10 Drawing Sheets

FIG. 3
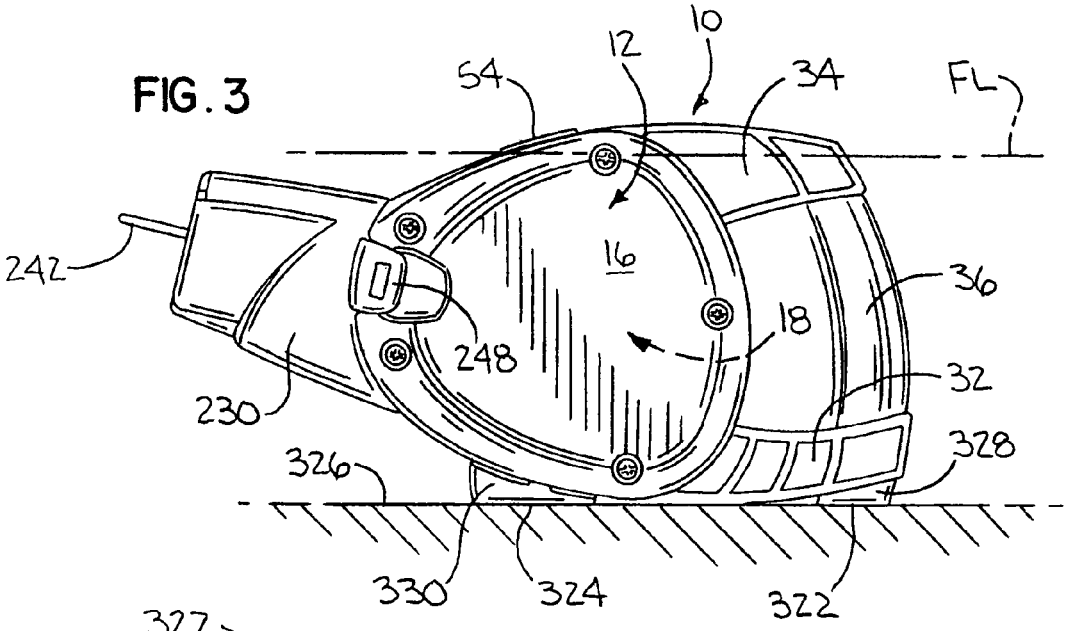
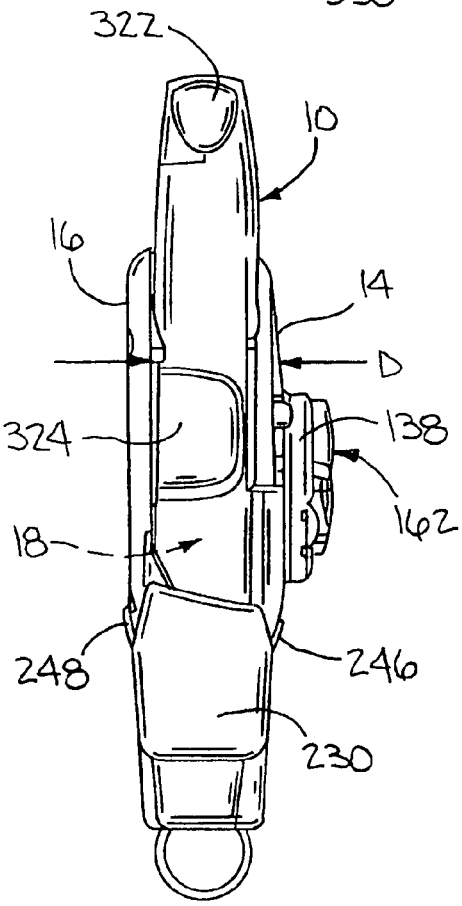
FIG. 4
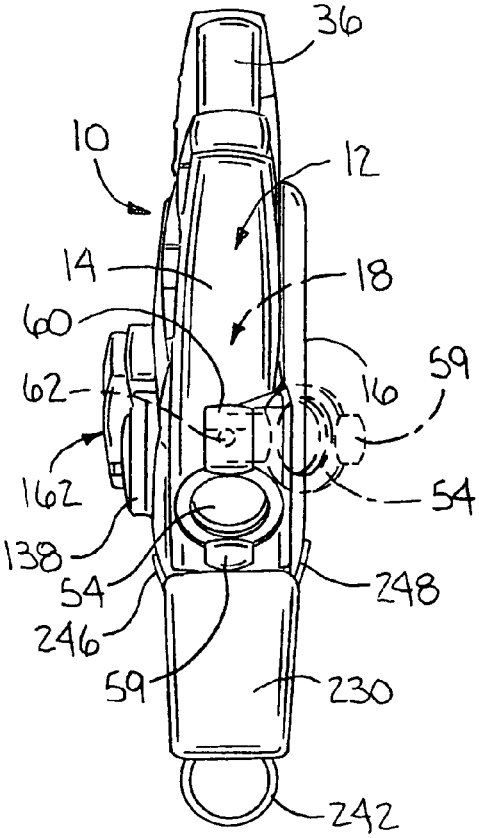
FIG. 5

FIG. 9
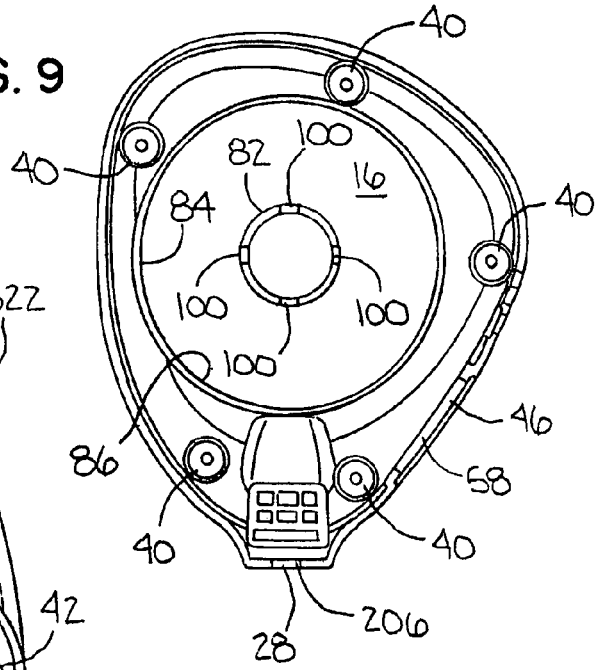
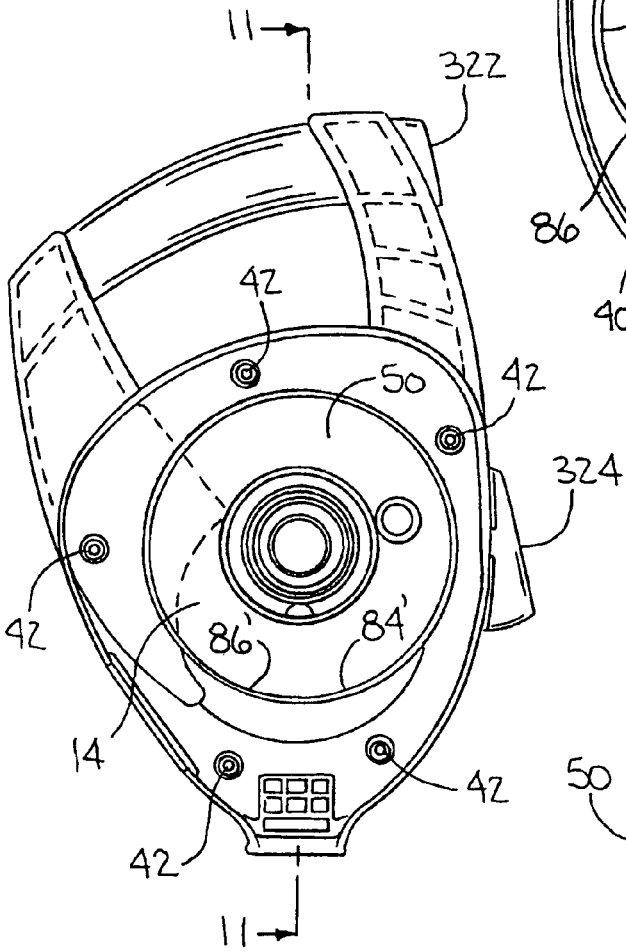
FIG. 10
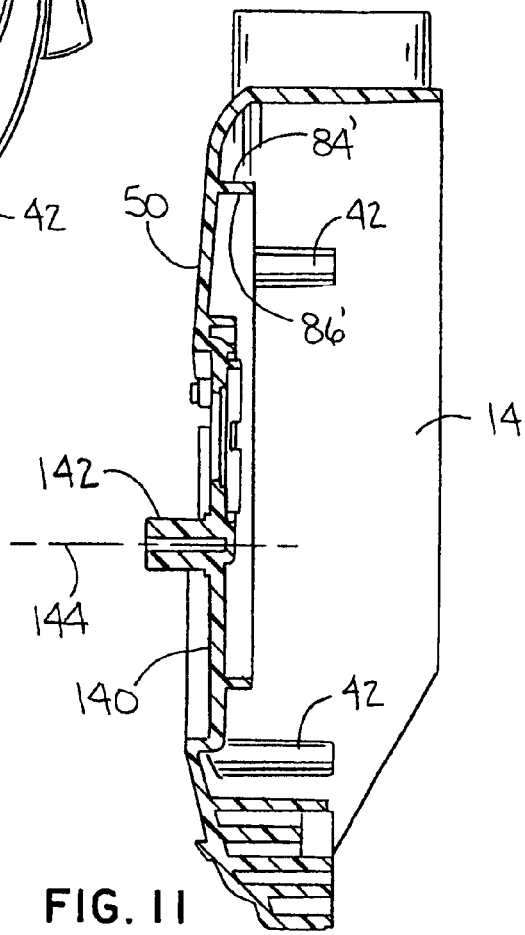
FIG. 11

FIG. 18
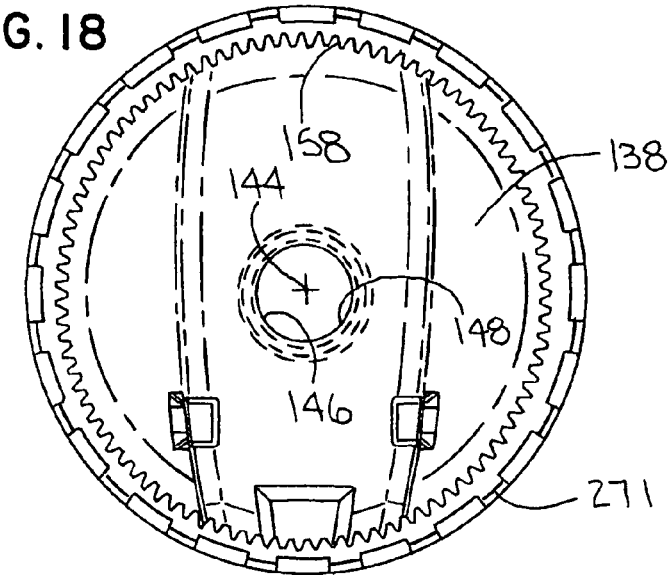
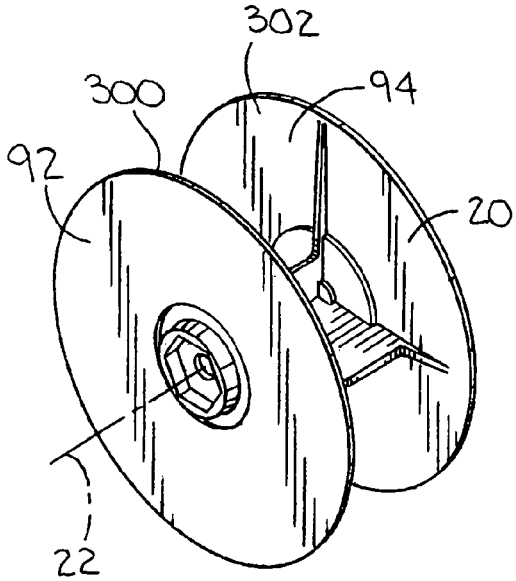
FIG. 19
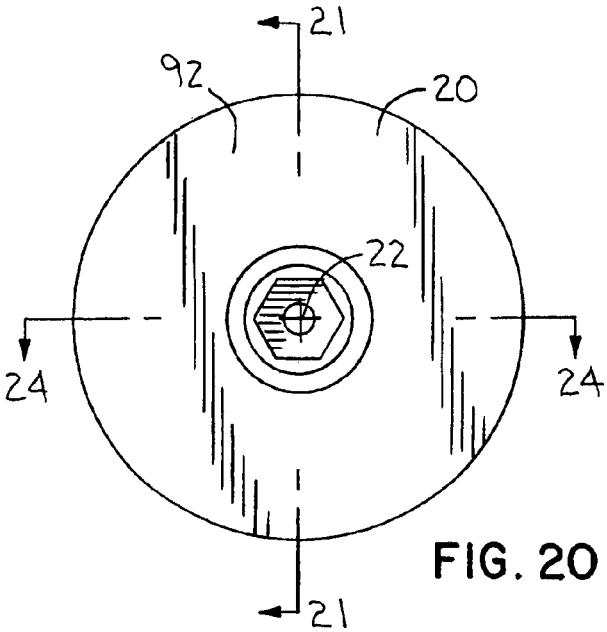
FIG. 20

CHALK LINE APPARATUS WITH A SPOOL CONFIGURED TO AVOID CAVITATION

BACKGROUND OF THE INVENTION

1. Field of the Invention

This invention relates to chalk line apparatus of the type having a spool that is rotated around an axis to selectively pay out and retrieve line.

2. Background Art

Chalk lines are used for projects by those in the construction trades as well as those that engage in hobbies that require "snapping" of a straight line of chalk. To accomplish this, a string laden with chalk is tensioned between two points on a surface and then "snapped" to cause the chalk to be deposited upon that surface.

Commonly, a supply of string is controlled using a chalk line apparatus having a housing that defines a chamber within which a reel and a supply of chalk are contained. Through a handle, the reel can be turned around an axis in one direction to wrap the string around a spool on the reel. By exerting a force on a portion of the string that projects from an opening through the housing, the reel can be rotated oppositely to the one direction to allow the string to be paid off of the spool.

The string within the housing chamber is exposed to the supply of chalk, thereby to allow adherence of the chalk thereto. The chalk supply is ideally loosely contained within the chamber so that as the housing is moved, the chalk cascades over the spool and the string wrapped therearound. The repeated exposure of the string to the loose chalk assures that there is a proper coating of the string that allows consistent quality lines to be "snapped".

Heretofore, the reels for the supply of line have been made with a cylindrical spool centered upon the rotary axis for the reel. Spaced, disc-shaped flanges, at the axial ends of the spool, determine the axial dimension of the string storage space.

With this conventional construction, as the spool is rotated to retrieve string, the string wraps around the outer spool surface to produce a progressively increasing cylindrical shape.

This conventional design has one significant drawback. The substantially constant cylindrical configuration of the outer spool surface, and the string that is progressively built up thereupon, tends to interact with the chalk supply, in which the spool and string are at least partially immersed, in a manner that the reel with the string thereon tends to "cavitate". With the chamber completely full of chalk, the rotating reel, with the string thereon, tends to form a cylindrical cavity in the accumulated chalk of progressively increasing diameter. As this occurs, there is a slight radial compaction of the chalk at the inwardly facing cavity edge that tends to maintain this edge intact. This compacted chalk tends to block passage of chalk to against the string wrapped around the spool.

With the string fully retrieved, the cavity has its maximum diameter. As string is paid off of the reel, the effective diameter of the spool with the string wrapped therearound progressively decreases. The reel may continue to rotate, in this manner, potentially without any significant amount of chalk migrating towards the spool and the string wrapped therearound. The end result may be that there is an inadequate coating of chalk on the string, which may account for a poor quality line or necessitate retrieval of the line and repeating of the steps carried out to initially snap the line.

While the above problem is potentially overcome by having the user shake the housing to break free chalk that is compacted to produce the cavitation effect, users may not routinely do this. Even if they do, having to perform the additional step is an inconvenience that ideally one would not have to contend with while using a chalk line apparatus.

Still further, this condition may be aggravated by environmental conditions. For example, in high humidity environments, or when working with the chalk line apparatus in snow or rain, the chalk retains moisture that may make it more susceptible to compacting in the housing chamber to cause the cavitation effect, described above.

Ideally, users of chalk line apparatus would be able to repeatedly retrieve and pay out string to produce high quality lines without having to take any special steps to avoid the above problem.

SUMMARY OF THE INVENTION

In one form the invention is directed to a chalk line apparatus having a housing defining a chamber within which a supply of chalk can be stored and a reel within the chamber and mounted for rotation relative to the housing around a first axis. The housing has an opening through which a flexible line emanating from the reel can extend to outwardly of the housing for use. The reel has a spool defining a support against and around which a flexible line can be wrapped. The spool is rotatable around the first axis and has an axial extent. The spool is configured so that line wrapped around the support does not have a substantially cylindrical shape centered on the first axis over any substantial portion of the axial extent of the spool.

In one form, the spool has at least a first fin that projects radially relative to the first axis and has a radially facing first edge that defines a part of the support.

The spool may have a second fin that projects radially relative to the first axis and has a radially facing second edge that defines a part of the support.

The first and second edges may be spaced different radial distances from the first axis.

In one form, the first and second edges each extends substantially parallel to the first axis over a majority of the axial extent of the spool.

In one form, the first and second edges are spaced angularly with respect to each other through approximately 90°.

The first and second fins may project diametrically oppositely with respect to the first axis.

In one form, the spool has third and fourth fins that project radially relative to the first axis. The third and fourth fins have radially facing third and fourth edges that define a part of the support.

In one form, the third and fourth fins project diametrically oppositely with respect to the first axis.

In one form, the first, second, third and fourth edges each extends substantially parallel to the first axis over a majority of the axial extent of the spool.

The first and third edges may be spaced different radial distances from the first axis.

A chalk line may be provided in combination with a supply of chalk in the chamber.

The combination may further include a length of a flexible line that is wrapped around the support.

In another form, a chalk line apparatus is provided having a housing defining a chamber within which a supply of chalk can be stored and a reel within the chamber and mounted for rotation relative to the housing around a first axis. The housing has an opening through which a flexible line emanating from the reel can extend to outwardly of the housing for use. The reel has a spool defining a support against and around which a flexible line can be wrapped. The spool is rotatable around the first axis and has an axial extent. The support is configured so that the support does not engage an accumulation of line wrapped around the support substantially continuously in a circular region centered on the first axis over any substantial portion of the axial extent of the spool.

In one form, the support consists of a plurality of edges that are spaced angularly with respect to each other around the first axis.

In one form, there are at least three edges that are spaced angularly with respect to each other around the first axis.

The edges may be defined by fins that project radially relative to the first axis.

In one form, first and second of the edges extend substantially parallel to the first axis.

The first and second edges may be spaced different radial distances from the first axis.

In another form, a chalk line is provided having a housing defining a chamber within which a supply of chalk can be stored and a reel within the chamber and mounted for rotation relative to the housing around a first axis. The housing has an opening through which a flexible line emanating from the reel can extend to outwardly of the housing for use. The reel has a spool defining a support against and around which a flexible line can be wrapped. The support has first and second discrete parts against which a flexible line wrapped against and around the support bears.

In one form, the first and second discrete parts have first and second discrete, radially facing surfaces/edges against which a flexible line wrapped against and around the support bears.

In one form, at least a part of the first discrete radially facing surface is spaced further from the first axis than a part of the second discrete radially facing surface.

BRIEF DESCRIPTION OF THE DRAWINGS

FIG. 3 is a rear elevation view of the chalk line apparatus in FIGS. 1 and 2;

FIG. 4 is a left side elevation view of the chalk line apparatus in FIGS. 1-3;

FIG. 5 is a right side elevation view of the chalk line apparatus in FIGS. 1-4;

FIG. 9 is a front elevation view of one of two joinable housing parts that bounds the chalk supply chamber;

FIG. 10 is a rear elevation view of the housing part that is joined to the housing part in FIG. 9 to bound the chalk supply chamber;

FIG. 11 is an enlarged, cross-sectional view of the housing part taken along lines 11-11 of FIG. 10;

FIG. 18 is an enlarged, rear elevation view of the crank housing in FIGS. 16 and 17;

FIG. 19 is an enlarged, perspective view of a reel for containing a supply of flexible line within the housing chamber and that is rotatable through the crank housing around an axis to selectively retrieve and pay off line;

FIG. 20 is an enlarged, front, elevation view of the reel in FIG. 19;

DETAILED DESCRIPTION OF THE DRAWINGS

Figure 1:
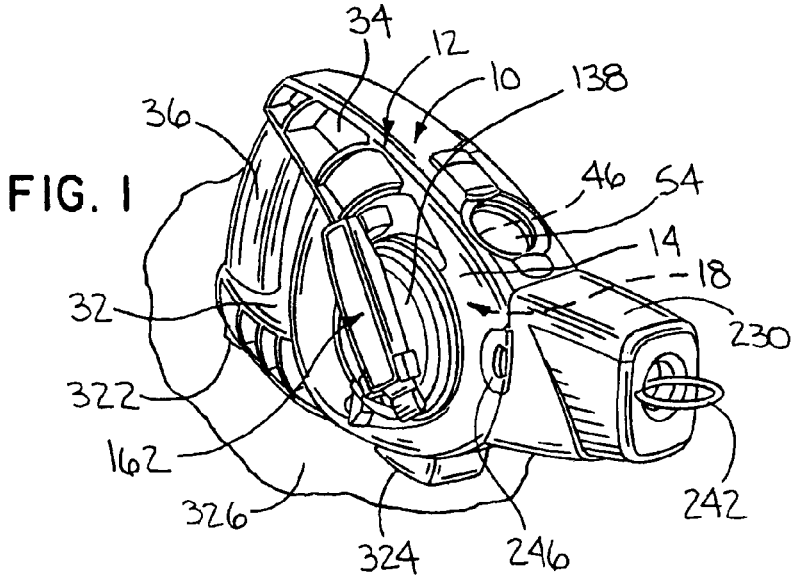
FIG. 1 is a perspective view of a chalk line apparatus, according to the present invention and situated upon a support in an orientation that facilitates direction of a chalk supply into a chamber bounded by a housing on the apparatus.
Figure 2:
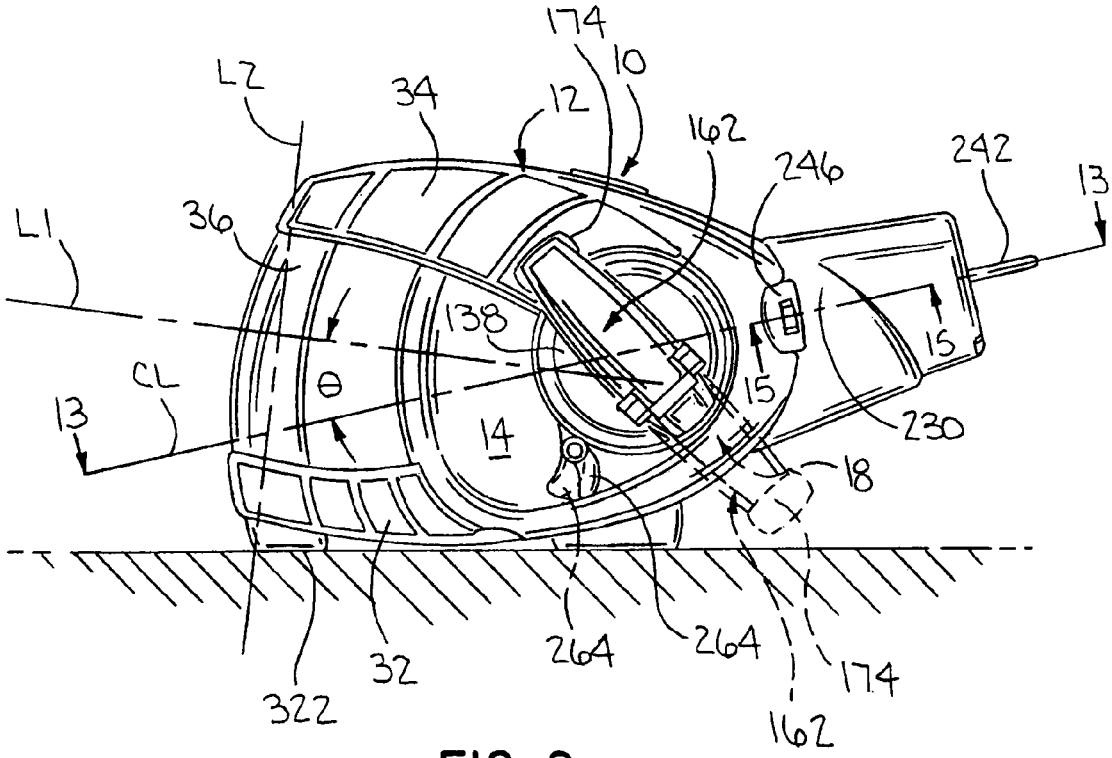
FIG. 2 is a front elevation view of the chalk line apparatus in FIG. 1.
Figure 6:
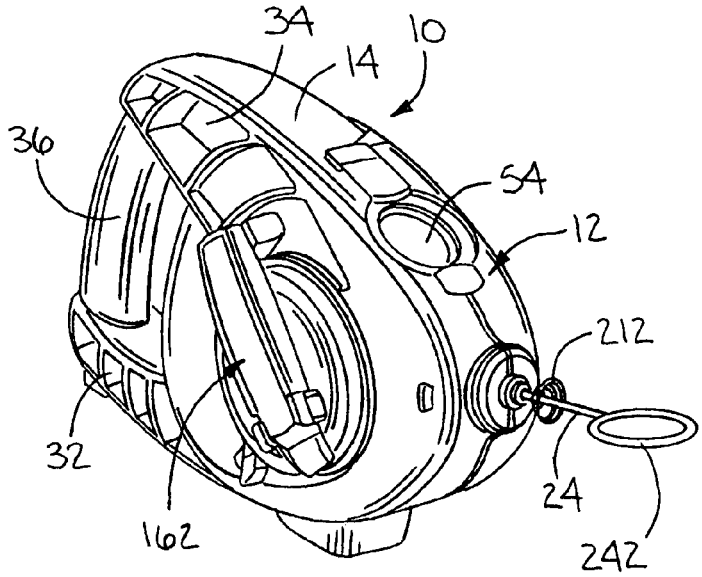
FIG. 6 is a view of the inventive chalk line apparatus, as in FIG. 1, wherein a collection container for chalk is separated from the remainder of the housing.
Figure 7:
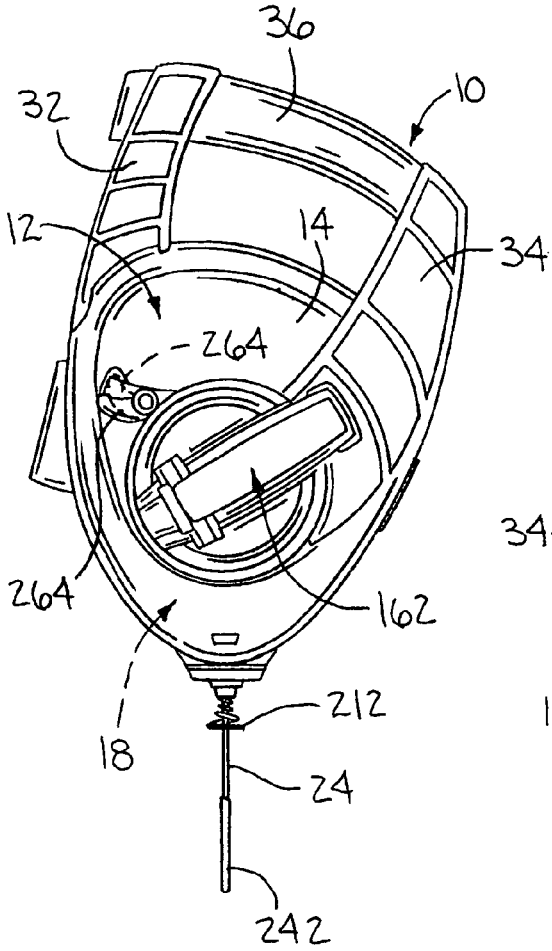
FIG. 7 is a front elevation view of the chalk line apparatus in FIG. 6.
Figure 8:
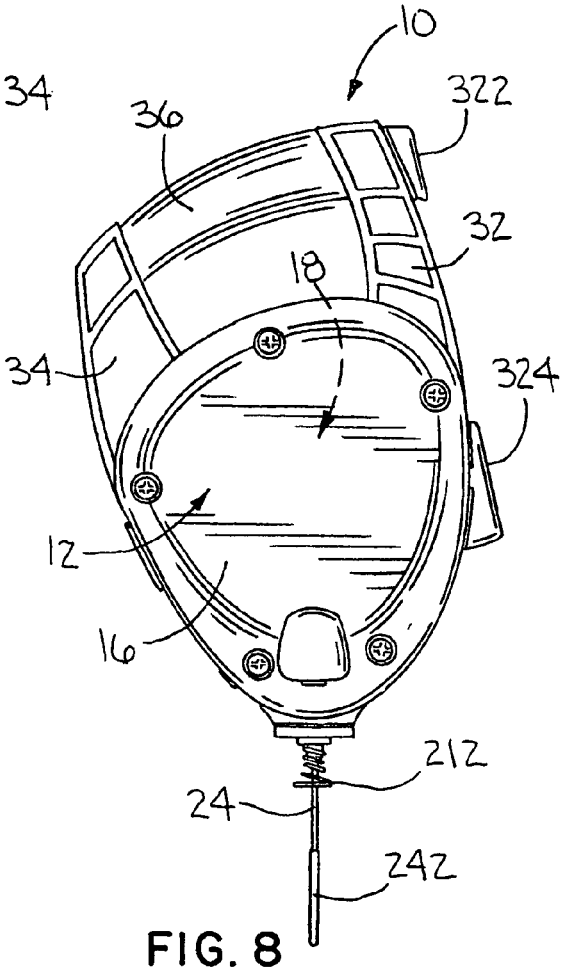
FIG. 8 is a rear elevation view of the chalk line apparatus in FIGS. 6 and 7.

The chalk line apparatus, according to the present invention, is shown at 10 in FIGS. 1-24. The chalk line apparatus 10 consists of a housing 12 made up of joinable housing parts 14, 16. The housing parts 14, 16 cooperatively bound a chamber 18 within which a reel 20 is mounted for rotation around an axis 22. A supply of string/flexible line ("flexible line") 24 is wrapped around a spool 26 on the reel 20. The flexible line 24 emanating from the reel 20 is extended out of the chamber 18 through an opening 28 in the housing 12. As explained in greater detail below, the flexible line 24 is: a) retrieved by rotating the reel 20 in one direction around the axis 22 to cause the flexible line 24 to wrap around the spool 26; and b) paid off of the spool 26 by oppositely rotating the reel 20. The chamber 18 also contains a supply of chalk 30 to which the flexible line 24 within the chamber 18 is exposed to be adhered thereto.

The housing 12, as viewed from the front thereof, has a truncated "V" shape, whereby an accumulation of chalk 30 within the chamber 18 tends to gravitationally migrate towards the lower region of the chamber 18 at which the flexible line 24 projects from the chamber 18 through the housing opening 28.

The housing 12 has spaced, upwardly projecting arms 32, 34 that are spanned by a curved bar 36 that functions as a graspable handle through which the chalk line apparatus 10 can be held and repositioned. The arms 32, 34 project generally parallel to a line L1 (FIG. 2) that makes an angle Θ with the vertical center line CL of the housing 12. As a result, the lengthwise center line L2 of the bar/handle 36 is non-orthogonal to the housing center line CL, whereby the user's wrist is comfortably angled with the bar/handle 36 grasped with the user's fingers surrounding the same for use.

The arms 32, 34, as well as the bridging bar/handle 36, are formed entirely on the housing part 14. The housing part 14 has a front to rear dimension D (FIG. 4) beneath the arms 32, 34 which defines substantially the entire depth dimension of the chamber 18. With this arrangement, the housing part 16 performs the function primarily of a cover. Accordingly, in the event that the housing parts 14, 16 must be separated with a significant amount of chalk 30 within the chamber 18, the housing 12 can be situated with the housing part 16 facing upwardly preparatory to separation. Upon separating the housing part 16 with the housing part 14 so situated, the chalk 30 within the chamber 18 may be substantially entirely confined by the housing part 14 within the chamber 18, without fear of spillage.

The housing parts 14, 16 are releasably maintained together by a plurality of threaded fasteners 38 that are each directed from rear to front through a stub post 40 on the housing part 16 into an aligned stub post 42 on the housing part 14. A plurality, and like number, of stub posts 40, 42 are respectively provided on the housing parts 16, 14 and abut to maintain an aligned and fixed relationship between the housing parts 14, 16, as seen most clearly in FIG. 13.

In this embodiment, the housing parts 14, 16 may be made from plastic through an injection molding process. The handle 36 may be over molded with a rubber composition 44 for purposes of comfort. The precise configuration of the housing 12 and its materials of construction are not critical to the present invention. The chamber 18 is filled with chalk 30 through a fill opening 46 on a peripheral wall portion 48 surrounding the chamber 18 between front and rear walls 50, 52 on the housing 12, defined respectively by the housing parts 14, 16. The fill opening 46 is provided at a location between the reel 20 and housing opening 28 through which the flexible line 24 departs from the chamber 18. Chalk 30 can be directed through the fill opening 46 in conventional fashion. For example, it is known to provide chalk containers (not shown) with nozzles that can be directed into the fill opening 46 to controllably deliver the chalk 30 into the chamber 18 therethrough.

The fill opening 46 is selectively blocked by a removable stopper 54. The stopper 54 may be made from a rubber material so that a cylindrical body 56 thereon can be frictionally pressed, sealingly against a complementary rim 58 bounding the fill opening 46.

The stopper 54 has integrally formed, diametrically oppositely projecting, tabs 59, 60. The tab 60 has an integral, headed post 62 that can be pressed into an opening 63 in the housing 12. The tab 59 can be grasped to facilitate outward drawing of the stopper 54 to effect separation of the cylindrical body 56 from the rim 58, whereupon the stopper can be pivoted around the axis of the post 62 to the dotted line position in FIG. 5. In this position, the stopper 54 remains tethered to the housing 12 but does not obstruct access to the fill opening 46.

In this embodiment, the housing part 16 has a forwardly projecting wall portion 64 that fits in a complementary receptacle 66 on the housing part 14. This allows arcuate portions of the rim 58 to be partially formed on each of the housing part 14, 16, so as to facilitate molding of these parts.

The reel 20 is captively maintained between the front and rear walls 50, 52 on the housing parts 14, 16 in its operative position. The housing part 16 has concentric rims 82, 84 projecting forwardly from the rear wall 52. The rim 84 has a radially inwardly facing surface 86 that is concentric with the axis 22 and slightly greater in diameter than peripheral edges 88, 90, respectively on disk-shaped flanges 92, 94 that bound the axial dimension of the spool 26.

The rim 82 and a spool bearing 96 are keyed together through a plurality of peripherally spaced, and cooperating, pairs of tabs 98 and slots 100 thereon.

Figure 12:
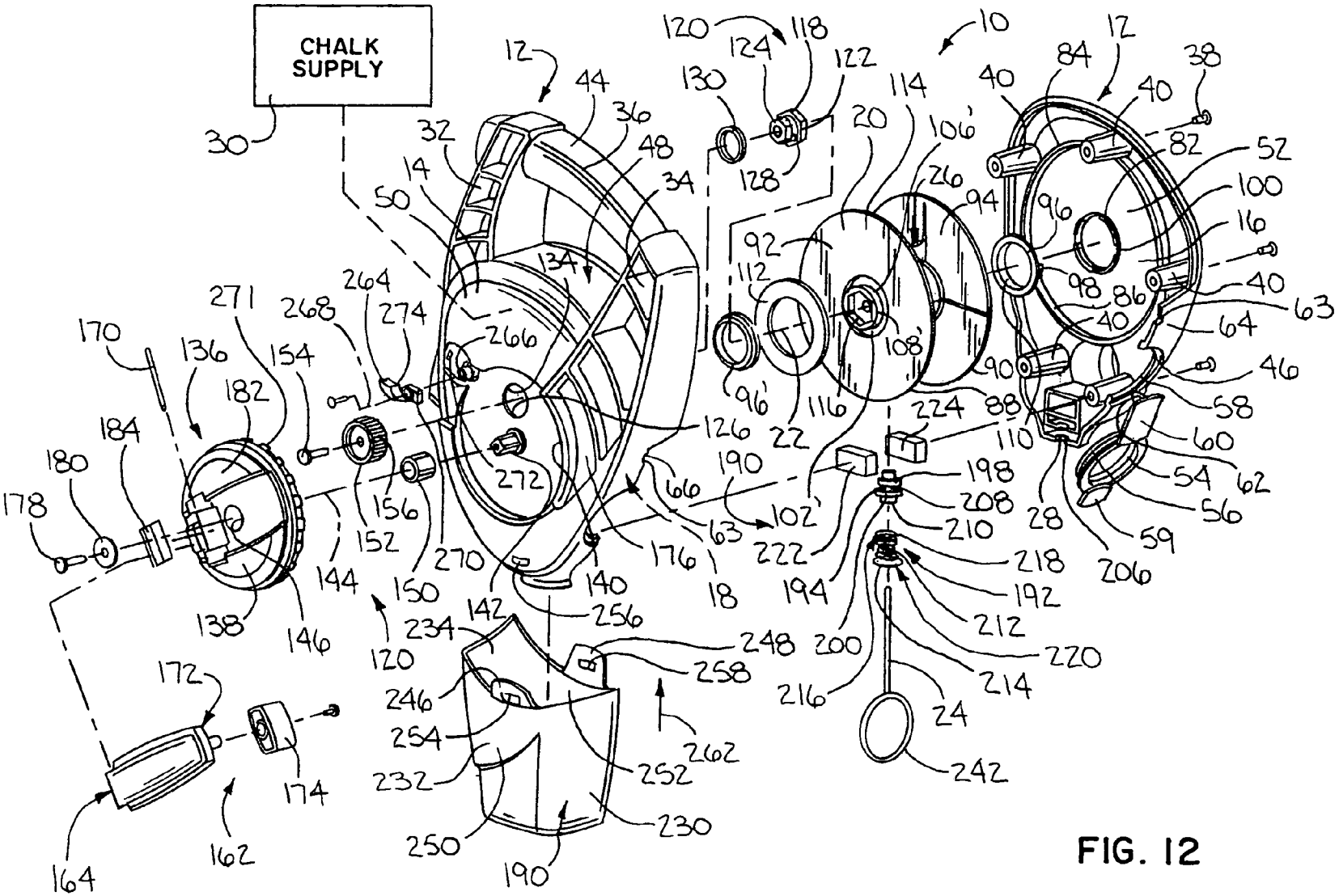
FIG. 12 is an exploded, perspective view of the chalk line apparatus in FIGS. 1-5.
Figure 13:
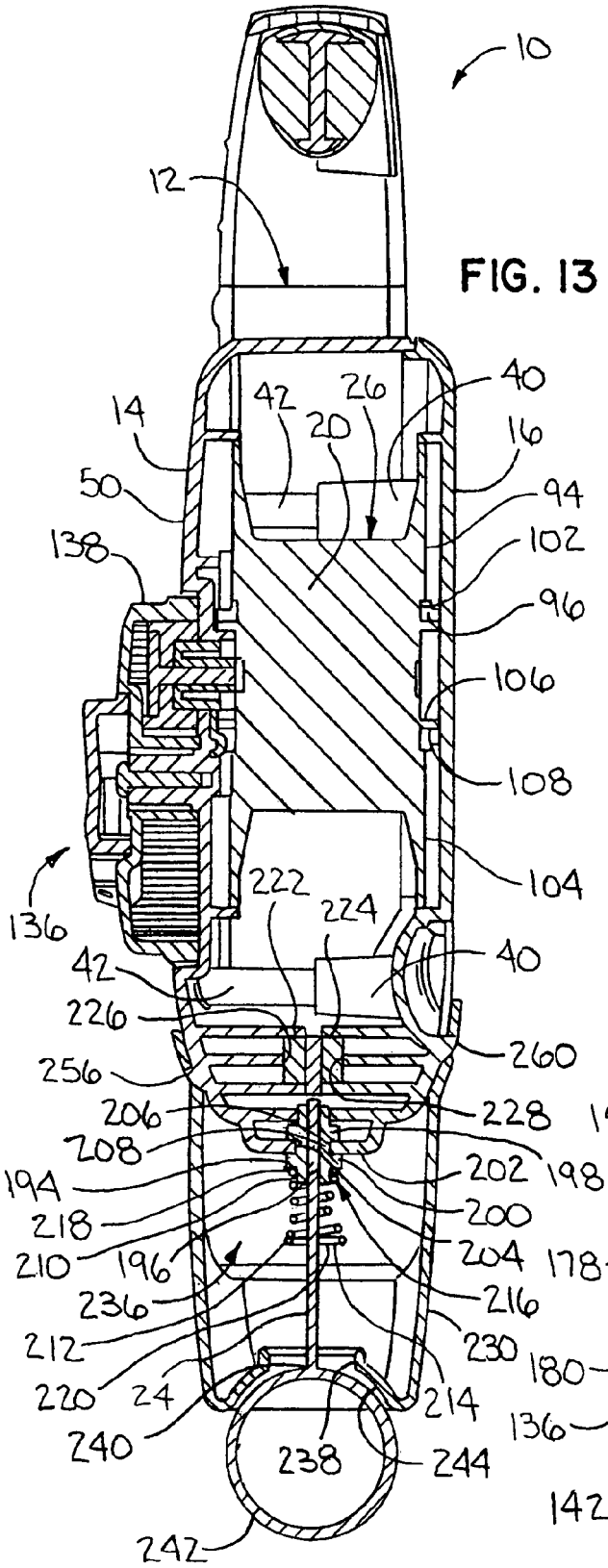
FIG. 13 is a cross-sectional view of the chalk line apparatus taken along line 13-13 of FIG. 2.

As seen most clearly in FIGS. 12 and 13, the reel 20 has an annular undercut 102 at the rearwardly facing surface 104 on the flange 94. The undercut 102 is dimensioned to receive the spool bearing 96. The reel 20 has an annular stub shaft 106 with a radially outwardly facing surface 108 that is guided against a radially inwardly facing surface 110 on the spool bearing 96.

Figure 14:
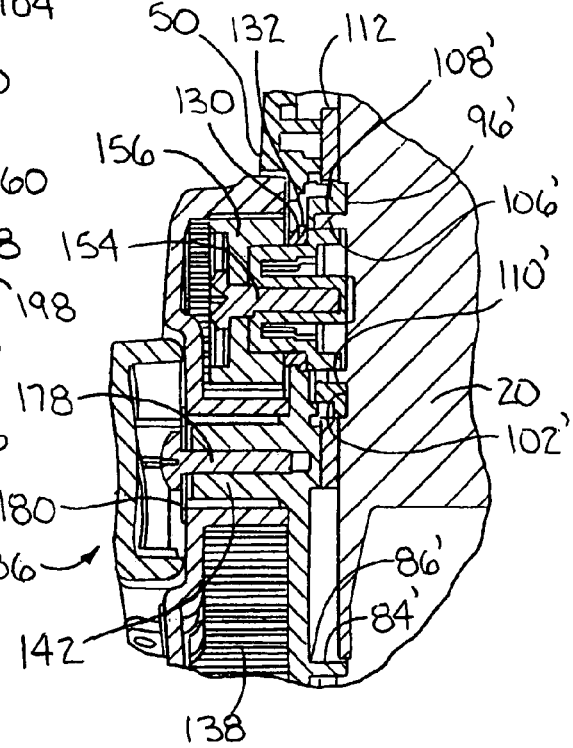
FIG. 14 is an enlarged, cross sectional view of the circled portion of the chalk line apparatus shown in FIG. 13.
Figure 15:
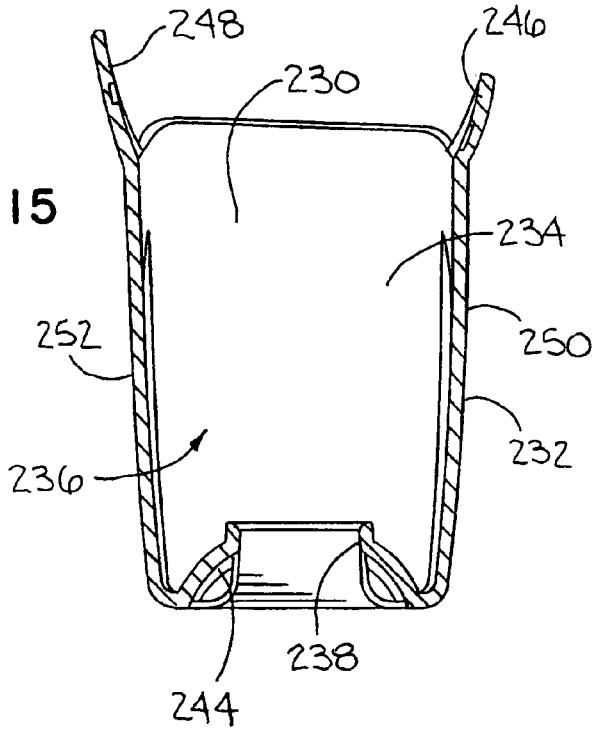
FIG. 15 is a cross-sectional view of the chalk collection container taken along lines 15-15 of FIG. 2.
Figure 16:
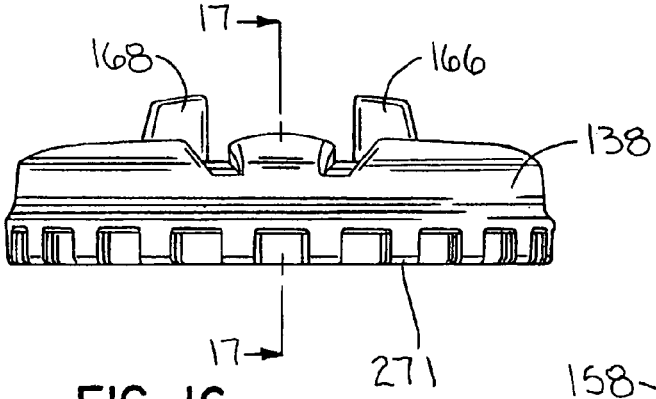
FIG. 16 is an enlarged, side elevation view of a crank housing that is rotated to retrieve line into the chalk line apparatus.
Figure 17:
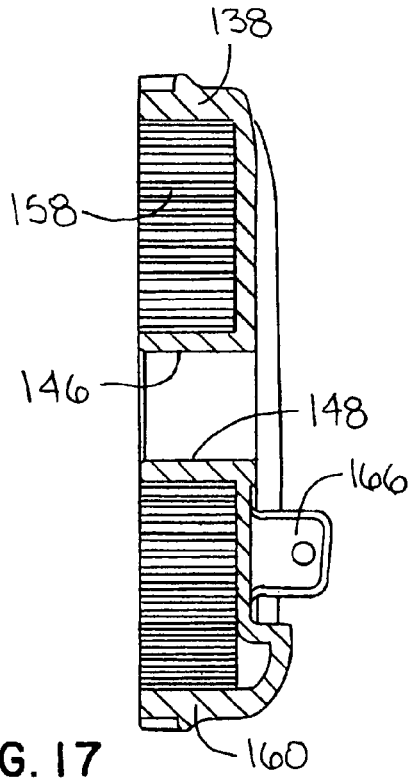
FIG. 17 is an enlarged, cross-sectional view of the crank housing taken along lines 17-17 of FIG. 16.

As seen most clearly in FIGS. 12 and 14, the reel 20, at the front thereof, is similarly configured with an undercut 102' for receiving a spool bearing 96', that is in turn keyed against rotation relative to the front wall 50 on the housing part 14. A stub shaft 106' has a radially outwardly facing surface 108' that is guided against a radially inwardly facing surface 110' on the spool bearing 96'.

As seen in FIGS. 10 and 11, the front wall 50 has a rearwardly projecting, annular rim 84', corresponding to the rim 84, and having a radially inwardly facing surface 86' surrounding the reel flange 92.

A felt washer 112 surrounds the spool bearing 96' and maintains a seal between the forwardly facing surface 114 on the flange 92 and the front housing wall 50 around the stub shaft 106'.

The stub shaft 106' has a radially inwardly facing surface 116 that is polygonally-shaped to make keyed connection with a complementary pinion support 118, that is part of a drive mechanism at 120 for the reel 20. The pinion support 118 has a stepped diameter with a larger diameter portion 122 that makes keyed connection with the surface 116, and a smaller diameter portion 124 that projects through an opening 126 in the front wall 50 of the housing part 14 to be exposed at the front thereof. A transition portion 128, between the smaller and larger diameter portions 124, 122 of the pinion support 118, is surrounded by a bushing 130 (FIG. 14) having a stepped outer surface 132 that nests against a complementary edge 134 bounding the opening 126.

The drive mechanism 120 consists of a crank mechanism at 136 including a crank housing 138. The crank housing 138 has a generally cylindrical shape that seats within a complementarily-shaped undercut 140 opening forwardly from the front wall 50. The crank housing 138 is mounted to a stub shaft 142 projecting forwardly from at the center of the undercut 140 for pivoting movement about an axis 144 that is parallel to the axis 22. The crank housing 138 has a central through bore 146 bounded by a surface 148. A cylindrical bushing 150 surrounds the stub shaft 142 and is closely surrounded by the bore surface 148, thereby to guide pivoting movement of the crank housing 138 around the stub shaft 142 and its central axis 144.

A pinion gear 152 is secured by a threaded fastener 154 to the pinion support 118 at the portion 124 that is exposed through the opening 126. The pinion gear 152 has external teeth 156 that are in mesh with internal teeth 158 on a flange 160 on the crank housing 138 that is concentric with the shaft axis 144. With the teeth 156, 158 in mesh, pivoting movement of the crank housing 138 about the axis 144 drives the pinion gear 156, the pinion support 118 keyed thereto through the polygonally-shaped smaller diameter portion 124 thereon, and in turn the reel 20 keyed to the pinion support 118 through the larger diameter portion 122 thereon.

By reason of the geared arrangement described above, the gear ratio can be selected so that each full turn of the crank housing 138 about its axis 144 causes the pinion gear 152, and thus the associated reel 20, to turn through more than a full rotation. An exemplary gear ratio may be 3×1 to allow high speed retrieval of the flexible line 124. Any desired gear ratio can be selected, from one that is less than 1×1 to one greater than 3×1. It has been found that a gear ratio of 3×1 is desirable from the standpoint of allowing operation with a reasonable torque application upon the crank housing 138, while affording conveniently rapid retrieval of the flexible line 24.

To operate the crank housing 138, a crank handle 162 is provided. The crank handle 162 has an elongate shape with a mounting end 164 attached between two mounting ears 166, 168 on the crank housing 138 through a pin 170. Through this arrangement, the crank handle 162 is pivotable selectively between an operative position, as shown in dotted lines in FIG. 2, and a stored position, as shown in solid lines in that same figure and in FIGS. 4-7 and 12.

At the crank handle end 172, remote from the mounting end 164, a crank knob 174 is mounted. With the crank handle 162 in its operative position, the crank knob 174 projects forwardly and is conveniently graspable to allow the user to turn the crank housing 138 about its axis 144. In the stored position for the crank handle, the crank knob 174 projects rearwardly into a receptacle 176 opening forwardly on the housing part 14.

The crank housing 138 is maintained upon the stub shaft 142 by a threaded fastener 178 that extends through a washer 180 that bears upon the front wall 182 of the crank housing 138.

A generally U-shaped leaf spring 184 is captive between the mounting end 164 of the crank handle 162 and the front wall 182 of the crank housing 138 and functions to resiliently maintain the crank handle 162 in each of its operative and stored positions.

Between the reel 20 and housing opening 28, a chalk control assembly is provided at 190. The chalk control assembly 190 in turn consists of a spring cleaner assembly 192. The spring cleaner assembly 192 consists of a line guide/spring support 194 defining a through passage 196 for the flexible line 24. The line guide/spring support 194 has spaced annular beads 198, 200 between which a surrounding wall 202, defined cooperatively by the housing parts 14, 16, captively resides with the housing 12 assembled. The housing parts 14, 16 respectively have arcuate edges 204, 206 that, with the housing parts 14, 16 joined, cooperatively produce a continuous circular shape that closely and captively surrounds a reduced diameter portion 208 of the line guide/spring cleaner 194 between the beads 198, 200.

The bottom end 210 of the line guide/spring support 194 has a diameter less than that of the bead 200, and is surrounded by a coiled cleaner spring 212 that is on the spring cleaner assembly 192. The cleaner spring 212 consists of a formed wire 214 with a mounting end 216 at which a series of turns 218 are formed. The turns 218 closely surround and frictionally engage the region at the bottom 210 of the line guide/spring support 194, thereby to frictionally maintain the line guide/spring support 194 and cleaner spring 212 in operative relationship.

The turns 218 of the cleaner spring 212 decrease in diameter away from the mounting end 216 and then progressively increase in diameter up to a free end 220.

The flexible line 24 is directed through the line guide/spring support 194 and the cleaner spring 212, which is mounted outside of the housing 12 upon the projecting bottom end 210 on the line guide/spring support 194.

It has been found that the cleaner spring 212, as described, intercepts chalk 30 on the flexible line 24 that might otherwise have a tendency to spray in the vicinity of the housing opening 28 as the flexible line 24 is paid out.

This condition is further avoided by including as part of the chalk control assembly 190 a pair of felt pads 222, 224, between which the flexible line 24 resides between the reel 20 and the line guide/spring support 194. The felt pads 222, 224 reside respectively in receptacles 226, 228 on the housing parts 14, 16. With the housing parts 14, 16 assembled, the flexible line 24 becomes captive between the felt pads 222, 224 which are slightly deformed/compressed by the flexible line 24. The pads 222, 224 tend to squeeze chalk into the flexible line 24 and at the same time strip excess chalk as the flexible line 24 passes therebetween.

Chalk 30 that is intercepted by the cleaner spring 212, or separates on its own, is accumulated in, and contained by, a collection container 230, that is part of the chalk control assembly 190. The collection container 230 is generally cup-shaped and has a peripheral wall 232 that has an inside surface 234 with an upper portion that conforms substantially to the bottom region of the housing 12. With the collection container 230 in its operative position, the cleaner spring 212 resides fully within a collection space 236 bounded by the collection container 230.

The collection container 230 has a bottom opening 238 through which the flexible line 24 extends. The free end 240 of the flexible line 24 connects to a circular ring 242 that blocks passage of the free line end 240 back through the bottom opening 238. The bottom region of the collection container 230 has a concave surface 244 that is nominally complementary to the shape of the ring 242 so that the ring 242 can be drawn thereagainst to be stored in a less obtrusive state.

The collection container 230 is releasably connected to the housing 12. To accomplish this, a pair of deflectable tabs 246, 248 is provided on spaced wall portions 250, 252 on the collection container 230. The tab 246 has a through opening 254 that defines a receptacle for a ramped projection 256 on the housing part 14. The tab 248 has a like through opening that defines a receptacle 258 for a ramped projection 260 on the housing part 16.

The tabs 246, 248 are spaced so that as the collection container 230 is directed upwardly in the direction of the arrow 262 from a spaced position, as shown in FIG. 12, to its operative position, the tabs 246, 248 contact the projections 256, 260 and are progressively urged outwardly away from each other to increase the effective spacing therebetween. Once the projections 256, 260 register with the through openings/receptacles 254, 258, the tabs 246, 248 spring back to an undeformed state whereupon the projections 256, 260 seat in the through openings/receptacles 254, 258 to thereby maintain the housing 12 and collection container 230 in operative relationship.

Once an accumulation of chalk 30 is present in the collection container 230, the collection container 230 can be separated from the housing 12 by manually engaging and spreading the tabs 246, 248 and reversing the assembly process. The accumulated chalk 30 can then either be poured back into the chamber 18 through the fill opening 46, or otherwise disposed of.

To operate the apparatus 10, a supply of chalk 30 is introduced to the chamber 18. With the chamber 18 full of chalk 30, the spool 26, and the flexible line 24 wrapped therearound, become immersed in the chalk 30. Between the location at which the flexible line 24 departs the reel 20 and encounters the felt pads 222, 224, the flexible line 24 is further directly exposed to chalk 30 accumulated in that region.

Preferably, the flexible line 24 is a string that may be made from cotton or loosely woven polyester that tends to retain chalk within its fibrous constitution. As the flexible line 24 is passed between and against the felt pads 222, 224, excessive amounts of chalk 30 adhered to the flexible line 24 are stripped, while at the same time the chalk 30 is pressed into the fibrous network so that the flexible line 24 is laden with the chalk 30.

As the flexible line 24 continues to be paid out, the cleaner spring 212 intercepts additional chalk 30 that is not firmly adhered to the flexible line 24. The desired amount of flexible line is drawn off, as by grasping the ring 242.

Once the desired length of the flexible line 24 is drawn off of the reel 20, the user ideally has the ability to lock the reel 20 against further movement about the axis 22. This is accomplished by a pawl 264 that is mounted to a stub post 266 on the housing part 14 for pivoting movement about an axis 268 between locked and released positions, as shown respectively in dotted lines and solid lines in FIGS. 2 and 7.

With the pawl 264 in its locked position, a nose 270 is directed between adjacent teeth 271 on the crank housing 138 to block rotation thereof about the axis 144. In the released position, the nose 270 resides outside of the path of the teeth 271 on the crank housing 138 so that the crank housing 138 is free to rotate.

A detent element 272 releasably blocks the pawl 264 in each of its locked and released positions. The detent element 272 resides in the path of the body 274 of the pawl 264 at a location spaced from the location at which the nose 270 resides. One or both of the detent element 272 and body 274 may deflect/deform enough to allow the pawl 264 to move against and past the detent element 272 in moving each of: a) from the locked position into the unlocked position; and b) from the unlocked position into the locked position.

Figure 25:
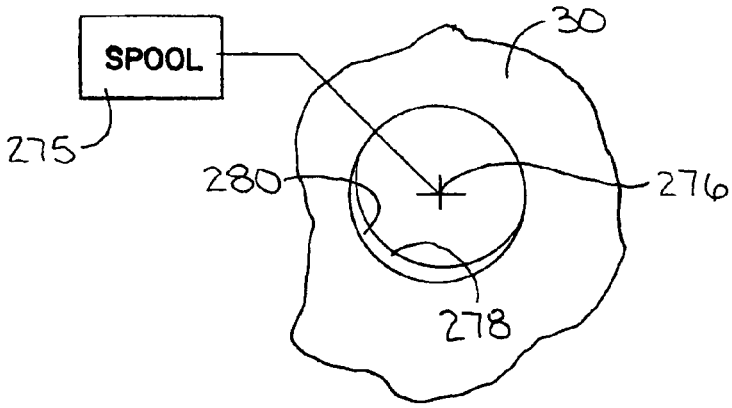
FIG. 25 is a fragmentary, perspective view of a supply of chalk in which a cavity is formed using conventional reels and in which the problem of cavitation exists.

As noted in the Background section herein, with conventional reel constructions, the spool 275 generally has a cylindrical shape centered on its rotary axis 276, as shown in FIG. 25. When the spool 275 is empty, the spool outer surface, around which line wraps, tends to carve out a cavity 278 bounded by an edge 280 consisting of chalk 30 that is compacted slightly radially outwardly with respect to the axis 176. As a result, the chalk 30 may remain in this configuration around the cavity so that the spool is not exposed to a replenishing supply of the chalk 30 and "cavitates". This condition continues as the flexible line 24 wraps around the spool 275, thereby increasing the diameter of the cavity 278 with the same cavitation effect.

The spool 26 on the inventive reel 20 is configured so that as the flexible line 24 is wrapped around the spool 26, there is not formed a cylindrical shape centered on the axis 22 over any substantial portion of the axial extent of the spool 26.

More particularly, as shown in FIGS. 12 and 19-25, rather than defining the flexible line support on the spool 26 as a continuous cylindrical surface centered around the axis 22, the support defined by the spool 26 for the flexible line 24 consists of a series of circumferentially spaced edges 282, 284, 286, 288. The edges 282, 284, 286, 288 are respectively defined on fins 290, 292, 294, 296, each projecting radially relative to the axis 22 and terminating at its respective edge 282, 284, 286, 288. Each edge 282, 284, 286, 288 faces radially to bear upon the flexible line 24 wrapped around the spool 26.

In the embodiment depicted, the reel flanges 92, 94 each has a diameter D1. The axial spacing D2 between facing flange surfaces 300, 302, the diameter D1, and the radial dimension of the fins 290, 292, 294,296 determine the capacity of the line storage space 304.

The fins 290, 292 each has a radial extent R that is less than a radial extent R1 for each of the fins 294, 296. In one exemplary form, R is equal to approximately one half inch, with R1 equal to approximately 1.375 inches. These dimensions are not intended to be limiting.

Figure 22:
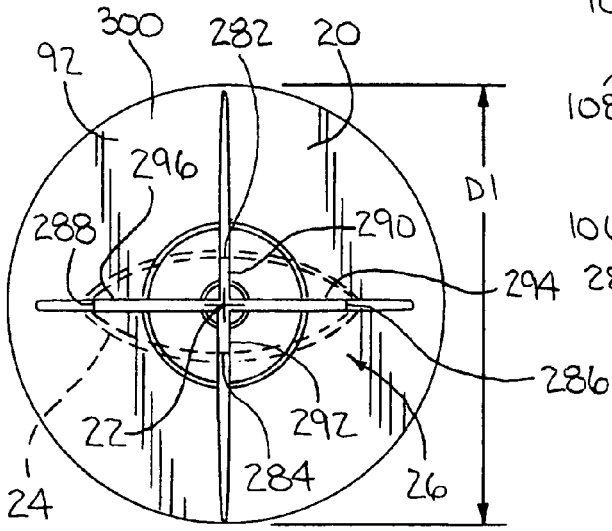
FIG. 22 is an enlarged, cross-sectional view of the reel taken along lines 22-22 of FIG. 21.
Figure 21:
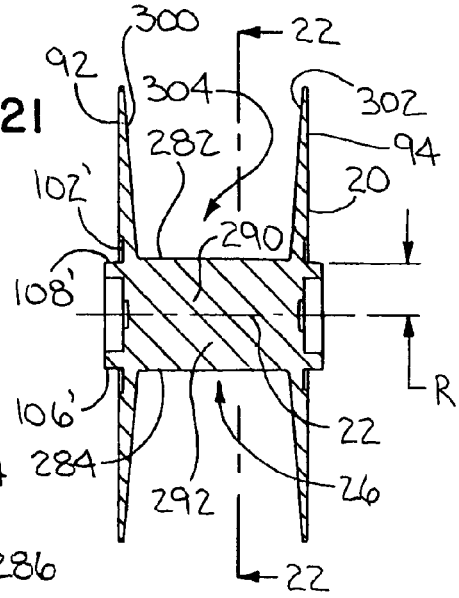
FIG. 21 is an enlarged, cross-sectional view of the reel taken along lines 21-21 of FIG. 20.
Figure 23:
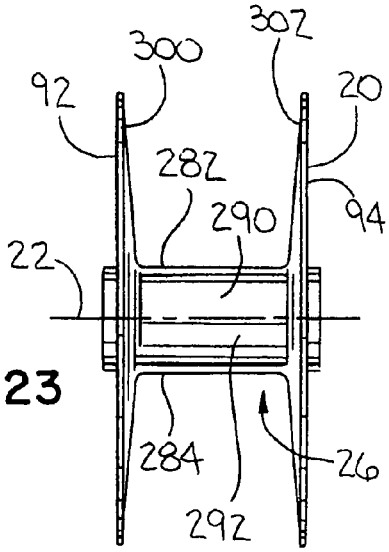
FIG. 23 is an enlarged, side, elevation view of the reel in FIG. 19.
Figure 24:
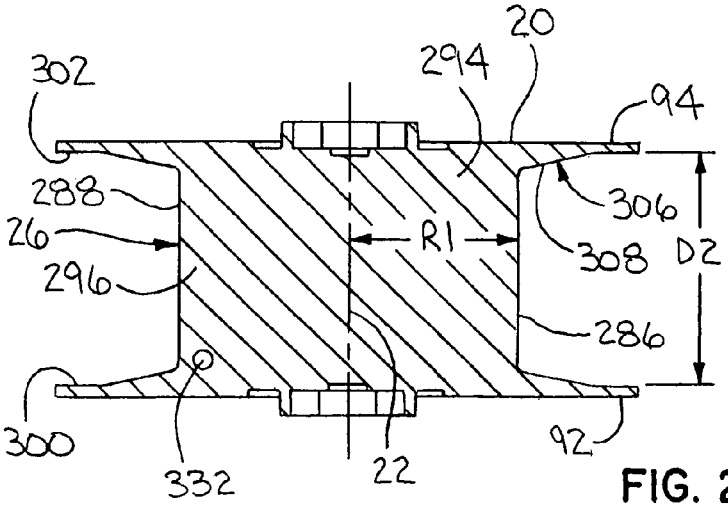
FIG. 24 is an enlarged, cross-sectional view of the reel taken along lines 24-24 of FIG. 20.

With the arrangement shown, the flexible line 24 wraps against the spool support, defined cooperatively by the edges 280, 282, 284, 286 as shown in FIG. 22, so that the flexible line 24 is wrapped in a non-circular, and generally elliptical shape, rather than in a cylindrical shape, as in the prior art.

Whereas a generally smooth, continuous, cylindrical shape around the axis 22 tends to cause a progressive compaction of the chalk 30 to produce a cavitation condition as shown in FIG. 25, as seen in FIG. 22, with the inventive structure, there is more localized contacting of the chalk supply 30 by the discrete edges 286, 288 as the reel 20 rotates, which produces a cutting action on the chalk 30 rather than a progressive smoothing or compaction of the chalk 30. This avoids the cavitation problem, discussed above.

In the depicted embodiment, the fins 290, 292, 294, 296 each has a generally flat shape with edges 282, 284, 286, 288 that are substantially straight and parallel to the reel axis 22. The edges 282, 284, 286, 288 extend in this straight line over a majority, and preferably substantially the entire axial extent, of the spool 26 between the flanges 92, 94. There is a slight transition portion at the axial ends of the fins 290, 292, 294, 296, as shown at 306 for the exemplary fin 294. At the transition portion, the fin 294 is diverted radially outwardly to define an angled edge portion 308 which performs a reinforcing function and also serves as an additional structure to break up chalk that may tend to compact as the reel 20 rotates around the axis 22. A similar transition portion may be provided at each axial end of each fin 290, 292, 294, 296.

While the shorter fins 290, 292 project diametrically oppositely from the axis 22, and the fins 294, 296 likewise project diametrically oppositely from the axis 22, this is not a requirement. Nor is it a requirement that there be any specific number of fins.

Figure 26:
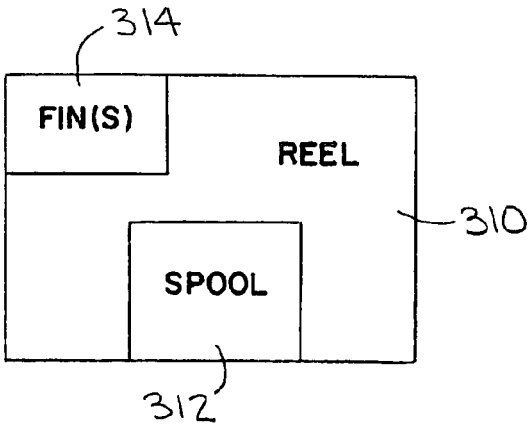
FIG. 26 is a schematic representation of one form of the inventive reel.

For example, as shown in FIG. 26, a generic form of the reel 310 consists of a spool 312 with one or more fins 314. The fins 314 may have virtually any number, orientation, and length, so long as the flexible line 24 wrapped therearound does not form a continuous cylindrical shape that promotes cavitation.

The support for the flexible line 24 can be defined by any number and shape of discrete edges, or surfaces with a locally greater circumferential dimension. As noted, it is not necessary that the edges/surfaces be defined by "fins", as shown.

Figure 27:
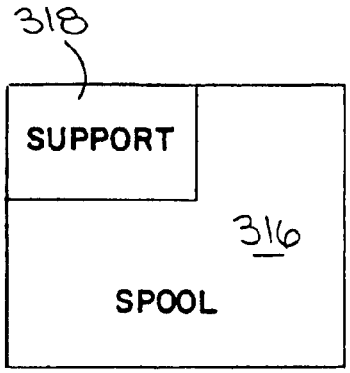
FIG. 27 is a schematic representation of another form of the inventive reel.

More specifically, as shown generally in FIG. 27, the invention contemplates any configuration of spool 316 that has a support 318 for wrapped line that does not engage an accumulation of line wrapped therearound substantially continuously in a circular region centered on the spool axis over any substantial portion of the axial extent of the spool 316.

Figure 28:
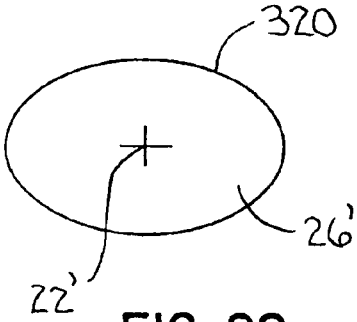
FIG. 28 is a schematic representation of yet another form of the inventive reel.

Further, it is not necessary that the support for the flexible line 24 be defined by a plurality of discrete edges. For example, as shown in FIG. 28, a spool 26' may have a line support 320 in the form of a continuous surface, that in this embodiment is elliptical or other non-circular shape, with respect to a rotational axis 22'.

Returning to the preferred embodiment in FIGS. 1-24, the reel 20 can be made from a single piece through an injection molding process. This is not a requirement, however. The reel 20 could be made from another material, such as metal or a composite and might be made from multiple, joined parts.

The invention contemplates many variations of the basic structure described above. For example, the use of the collection container 230 is optional. Further, it is not required that the spring cleaner assembly 192 be incorporated.

The chalk line apparatus 10 has other convenient features. For example, as shown in FIGS. 1 and 3, the housing 12 is provided with flat support surfaces 322, 324 that can be simultaneously, facially borne against an upwardly facing support 326 against which the apparatus 10 can be placed to orient the apparatus 10 in a fill orientation. The fill opening 46 opens upwardly, so that with the stopper 54 separated from the remainder of the housing 12, spillage of chalk 30 is not likely to occur. Further, with the housing 12 in the fill orientation, the chalk supply can be conveniently added up to a fill line FL (FIG. 3), whereby substantially the entirety of the volume of the chamber 18 is filled with the chalk 30 without the problem of spillage.

The surfaces 322, 324 can be provided respectively on components 328, 330 that may be molded rubber that will not damage the surface 326 against which they are placed, while at the same time avoiding inadvertent sliding of the housing 12 relative thereto as the filling operation is carried out.

To secure the end of the flexible line 24 to the spool 26, an opening 332 (FIG. 24) is provided in the reel 20. A free end of the flexible line 24 can be pressed into the opening 332 so that the same is anchored preparatory to winding.

The foregoing disclosure of specific embodiments is intended to be illustrative of the broad concepts comprehended by the invention.

The invention claimed is:

1. A chalk line apparatus comprising:
- a housing defining a chamber within which a supply of chalk can be stored; and
- a reel within the chamber and mounted for rotation relative to the housing around a first axis,
- the housing having an opening through which a flexible line emanating from the reel can extend to outwardly of the housing for use,
- the reel comprising a spool defining a support against and around which a flexible line can be wrapped,
- the spool rotatable around the first axis and having an axial extent,
- the spool configured so that line wrapped around the support does not have a substantially cylindrical shape centered on the first axis over any substantial portion of the axial extent of the spool.

2. The chalk line apparatus according to claim 1 wherein the spool comprises at least a first fin that projects radially relative to the first axis and has a radially facing first edge that defines a part of the support.

3. The chalk line apparatus according to claim 2 wherein the spool comprises a second fin that projects radially relative to the first axis and has a radially facing second edge that defines a part of the support.

4. The chalk line apparatus according to claim 3 wherein the first and second edges are spaced different radial distances from the first axis.

5. The chalk line apparatus according to claim 4 wherein the first and second edges each extends substantially parallel to the first axis over a majority of the axial extent of the spool.

6. The chalk line apparatus according to claim 4 wherein the first and second edges are spaced angularly with respect to each other through approximately 90°.

7. The chalk line apparatus according to claim 3 wherein the first and second fins project diametrically oppositely with respect to the first axis.

8. The chalk line apparatus according to claim 7 wherein the spool comprises third and fourth fins that project radially relative to the first axis, the third and fourth fins having radially facing third and fourth edges that define a part of the support.

9. The chalk line apparatus according to claim 8 wherein the third and fourth fins project diametrically oppositely with respect to the first axis.

10. The chalk line apparatus according to claim 9 wherein the first, second, third and fourth edges each extends substantially parallel to the first axis over a majority of the axial extent of the spool.

11. The chalk line apparatus according to claim 10 wherein the first and third edges are spaced different radial distances from the first axis.

12. The chalk line apparatus according to claim 1 in combination with a supply of chalk in the chamber.

13. The chalk line apparatus according to claim 1 in combination with a length of a flexible line that is wrapped around the support.

14. A chalk line apparatus comprising:
- a housing defining a chamber within which a supply of chalk can be stored; and
- a reel within the chamber and mounted for rotation relative to the housing around a first axis,
- the housing having an opening through which a flexible line emanating from the reel can extend to outwardly of the housing for use,
- the reel comprising a spool defining a support against and around which a flexible line can be wrapped,
- the spool rotatable around the first axis and having an axial extent,
- the support configured so that the support does not engage an accumulation of line wrapped around the support substantially continuously in a circular region centered on the first axis over any substantial portion of the axial extent of the spool.

15. The chalk line apparatus according to claim 14 wherein the support comprises a plurality of edges that are spaced angularly with respect to each other around the first axis.

16. The chalk line apparatus according to claim 15 wherein there are at least three edges that are spaced angularly with respect to each other around the first axis.

17. The chalk line apparatus according to claim 16 wherein the edges are defined by fins that project radially relative to the first axis.

18. The chalk line apparatus according to claim 17 wherein first and second of the edges extend substantially parallel to the first axis.

19. The chalk line apparatus according to claim 18 wherein the first and second edges are spaced different radial distances from the first axis.

20. A chalk line apparatus comprising:
- a housing defining a chamber within which a supply of chalk can be stored; and
- a reel within the chamber and mounted for rotation relative to the housing around a first axis,
- the housing having an opening through which a flexible line emanating from the reel can extend to outwardly of the housing for use,
- the reel comprising a spool defining a support against and around which a flexible line can be wrapped,
- the support comprising first and second discrete parts against which a flexible line wrapped against and around the support bears.

21. The chalk line apparatus according to claim 20 wherein the first and second discrete parts comprise first and second discrete, radially facing surfaces/edges against which a flexible line wrapped against and around the support bears.

22. The chalk line apparatus according to claim 21 wherein at least a part of the first discrete radially facing surface is spaced further from the first axis than a part of the second discrete radially facing surface.

* * * * *